US006600884B2

(12) United States Patent
Shimmura

(10) Patent No.: US 6,600,884 B2
(45) Date of Patent: Jul. 29, 2003

(54) METHOD AND APPARATUS FOR FORMING IMAGE

(75) Inventor: Shoko Shimmura, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/991,974

(22) Filed: Nov. 26, 2001

(65) Prior Publication Data

US 2003/0099477 A1 May 29, 2003

(51) Int. Cl.[7] ..... G03G 15/10
(52) U.S. Cl. ..... 399/57; 399/58; 399/239
(58) Field of Search ..... 399/57, 241, 245; 118/659, 660, 661, 688, 689, 690; 430/117, 118, 119

(56) References Cited

U.S. PATENT DOCUMENTS 4,310,238 A * 1/1982 Mochizuki et al. ..... 399/57

FOREIGN PATENT DOCUMENTS

JP 8-30921 3/1996

* cited by examiner

*Primary Examiner*—Hoang Ngo
(74) *Attorney, Agent, or Firm*—Foley & Lardner

(57) ABSTRACT

A developing apparatus of the present invention has a mechanism capable of reducing the conductivity of a toner liquid. When the conductivity of the toner liquid is increased as a result of the replenishment of the toner liquid, the conductivity of the toner liquid to a control initial value by a mechanism that can reduce the conductivity of the toner liquid, thereby a stabilized image can be obtained.

14 Claims, 5 Drawing Sheets

METHOD AND APPARATUS FOR FORMING IMAGE

BACKGROUND OF THE INVENTION

The present invention relates to an image forming apparatus which forms a toner image by using a liquid developer in which toner is dispersed in solvent.

In the image forming apparatus, for example, a copying apparatus in which an electrostatic copying process is utilized, an electrostatic latent image corresponding to an image of an original which is a copy object transferred on a photosensitive body as a clear contrast between light and shade is formed and copied by being visualized by toner which is a developer. As a method for supplying toner to an electrostatic latent image, there is known the liquid developer in which toner is dispersed in a solvent.

The image forming apparatus using the liquid developer can use toner having a small particle size in comparison to the image forming apparatus of a magnetic brush developing and is useful in order to enhance (high quality imaging) image quality.

The developer is mainly constituted by toner, a charge control agent and a solvent, and a counter ion having a polarity in reverse to the toner charged to a predetermined polarity, an excessive-ion (of the charge control agent) and the like suspend in the developer so as to bear an electric conductivity.

With respect to an image portion in which the electrostatic latent image exists in the developing area where, for example, the photosensitive body and the developer bearing body are located at a predetermined interval, the toner in the developer migrates toward the electrostatic latent image by the potential difference defined by the electrostatic latent image (the area in which the potential on the photosensitive body is changed) and the developing bias voltage applied to the developer bearing body. On the other hand, the counter ion migrates toward the developer bearing body.

In contrast, with respect to a non-image portion where the electrostatic latent image on the photosensitive body does not exist in the developing area, the toner migrates toward the developer bearing body by the potential difference in a reverse direction to the image portion defined by the potential of the photosensitive body, which maintains a charged potential as it is charged, and the developing bias voltage applied to the developer bearing body. In this case, the counter ion migrates toward the photosensitive body.

Meanwhile, when the surface of the developer bearing body is metal, the counter ion is neutralized (at the developer bearing body side) since a charge injecting reaction occurs. However, since the surface of the photosensitive body is dielectric, the charge injecting reaction does not occur.

For this reason, in the image portion, the excessive-ion (the counter ion) generated by the attachment of the toner to the photosensitive body and the removal of the potential from the toner, is vanished by the charge injecting reaction at the developer bearing body side, while, in the non-image portion, the ion does not increase or decrease and the amount of excessive-ion does not fluctuate.

However, in order to correct for the decrease of the toner density inside the developer (liquid) by the repetition of the image forming, when a condensed toner liquid in which the toner is condensed is replenished in the developing liquid, the amount of excessive-ion inside the developer increases as the condensed liquid is supplied due to the influence of the excessive-ion contained in the toner condensed liquid.

When the amount of excessive-ion in the developing liquid increases, the conductivity of the developing liquid becomes high and there arise problems that the electrostatic latent image on the photosensitive body is vanished or a toner image is confused, wherein the toner electrically adhered on the electrostatic latent image flows into the non-image portion before it is fixed.

Further, when the amount of charge control agent to be added is changed in order to control the amount of excessive-ion inside the developing liquid, there arises a problem that not only the amount of excessive-ion, but also a charge applying capacity to the toner, which is an intrinsic role of the charge control agent, changes.

For this reason, for example, in Jpn. Pat. Appln. KOKOKU Publication No. 8-30921, it is disclosed that the amount of charge control agent in the condensed toner is decreased than the amount necessary and an insufficient portion is independently added after an elapse of a predetermined period of time. In this Publication, there is noted that, when adding the want charge control agent, the amount of the charge control agent to be added is controlled while measuring the conductivity.

However, in order that the charge control agent is dissociated and is adhered on the charging site of each toner particle so that the charging amount of toner is stabilized, it takes a time unit of several hours to several days and therefore that is a problem that the method for adding the charge control agent while measuring the conductivity is substantially not suitable for use in the image forming apparatus.

BRIEF SUMMARY OF THE INVENTION

An object of this invention is to provide an image forming apparatus capable of controlling deterioration of a quality of an image caused by using a liquid developer in the image forming apparatus which uses the liquid developer.

This invention has been carried out in view of the above described problems and it is an object of this invention to provide an electrophotographic developing apparatus for developing an latent image on an photosensitive body by using a toner liquid where the toner is dispersed in non-polarity solvent and forming a toner image on the photosensitive body comprising:

- a charging apparatus which applies a predetermined potential on the photosensitive body;
- an exposing apparatus which forms an electrostatic latent image on the photosensitive body;
- a developing apparatus which includes a developing roller opposed to the photosensitive body at a predetermined interval, supplies the toner liquid to the electrostatic latent image formed on the photosensitive body while maintaining the toner liquid between itself and the photosensitive body, and forms a toner image by selectively adhering the toner on the electrostatic latent image;
- a toner liquid circulation mechanism which circulates the toner liquid maintained between itself and the photosensitive body by the developing roller of the developing apparatus while maintaining a toner density at a predetermined density;
- a developing bias power supply capable of applying a predetermined bias voltage to the developing apparatus;
- a conductivity detection mechanism which detects a conductivity inside the toner liquid circulated between the developing apparatus and the toner liquid circulation mechanism; and a conductivity control apparatus which reduces the conductivity of the toner liquid circulated between the developing apparatus and the toner liquid circulation mechanism to a predetermined level or less by vanishing a surplus counter ion inside the toner liquid and a charge of an excessive-ion having the same polarity as the toner.

Further, an object of this invention is to provide a method for developing a latent image on a photosensitive body by using a toner liquid in which the toner is dispersed in a non-polarity solvent and forming a toner image on the photosensitive body comprising:

providing a predetermined potential to the photosensitive body;

forming an electrostatic latent image on the photosensitive body by exposing an image on the photosensitive body by an exposing apparatus;

selectively supplying and developing the toner from the toner liquid on the electrostatic latent image; and replenishing an amount of toner consumed while developing the toner from the toner liquid on the electrostatic latent image by a condensed toner liquid in which a solid content density is higher than a density of the toner from the toner liquid, and reducing a conductivity of the toner liquid increased while replenishing the toner by a conductivity control apparatus so that an image forming condition is maintained constant.

Further, an object of this invention is to provide a developing apparatus for selectively supplying and developing a toner liquid in which toner particles are dispersed in a non-polarity solvent, on a latent image formed on a photosensitive body by using a toner liquid conveying mechanism and forming a toner image on the photosensitive body comprising:

a conductivity monitor apparatus which monitors the conductivity of the toner liquid; and an apparatus which reduces the conductivity when the conductivity of the toner liquid monitored by the conductivity monitor apparatus exceeds a predetermined level.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

The embodiments of this invention will be described below in detail based on the drawings.

Figure 1:
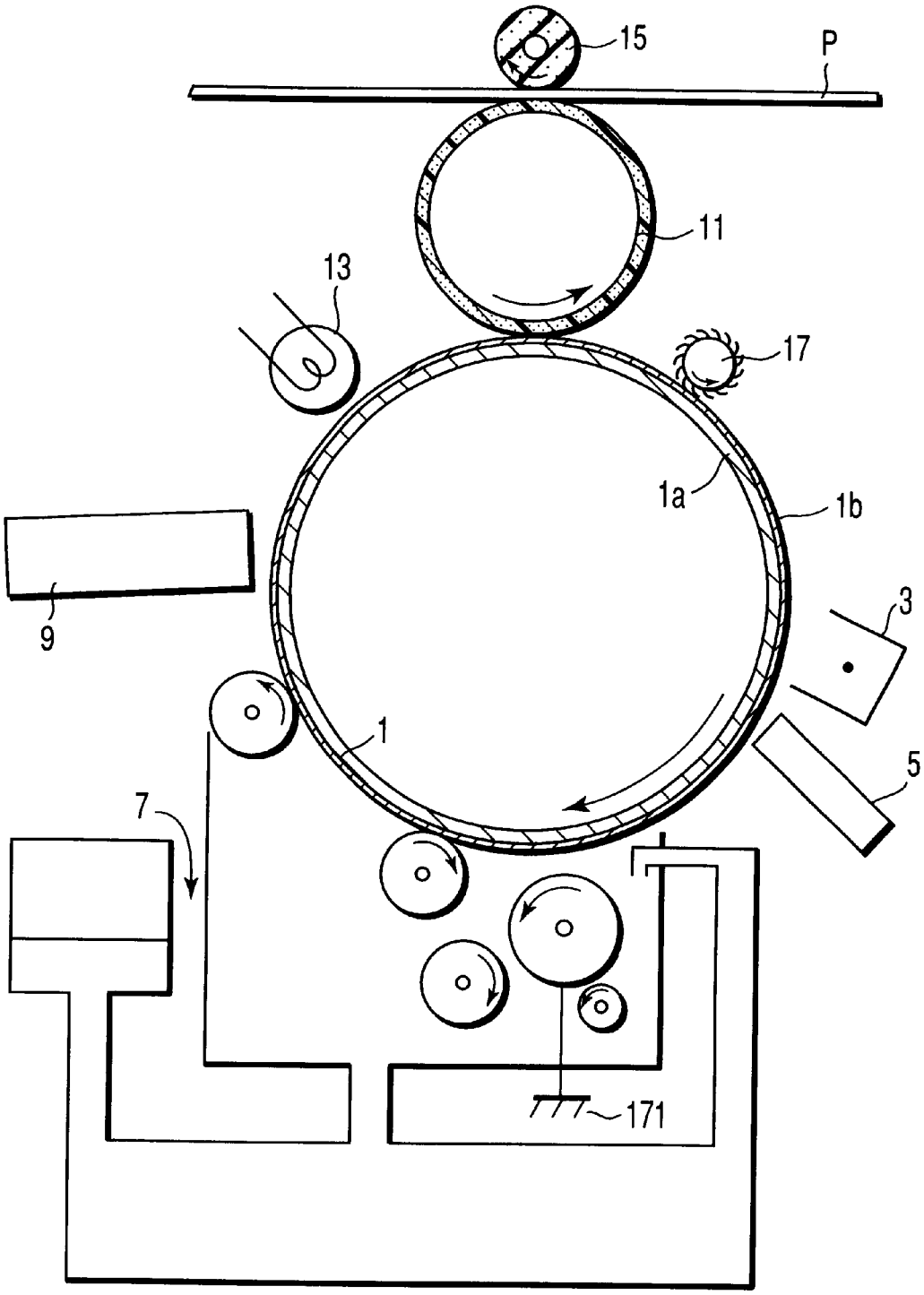
FIG. 1 is a schematic diagram for explaining an image forming apparatus using a liquid developer capable of being applied to one of the embodiments of the present invention.

FIG. 1 is a schematic diagram showing one example of an electrophographic apparatus (image forming apparatus) which develops an electrostatic latent image in which a potential retained by a photo semiconductor layer is changed by irradiation of an exposure light corresponding to an image by using a liquid developer in which the toner is dispersed in solvent, which is applicable to this invention.

In FIG. 1, the image forming apparatus has a photosensitive body 1, in which a photo semiconductor layer 1*b* having a predetermined thickness is formed on a substrate la formed by, for example, a cylindrical aluminum, a sheet shaped aluminum or the like. The photosensitive body 1 is an organic photosensitive body layer as a photo semiconductor layer having a predetermined thickness formed on a surface of a cylindrical body (drum) of aluminum having a diameter of, for example, 150 mm. On further outside of the organic photosensitive layer, a hard coat layer (surface protective layer) including a silicon based resin of about 1 $\mu$m is provided. Incidentally, as for the material suitable for the photo semiconductor layer 1*b*, amorphous silicon, selenium and the like can be utilized.

In a predetermined position of the outer peripheral surface of the photosensitive body 1, a charging apparatus 3 which applies a predetermined potential to the photo semiconductor layer 1*b* of the photosensitive body 1 is provided. As for the charging apparatus 3, as shown in the drawing, for example, a charging apparatus of a corona discharging system such as scorotron and the like or a contact charging system using such as a roller and the like to be described in the subsequent column by using FIG. 6 can be utilized. Further, in the example shown in FIG. 1, the photo semiconductor 1*b* of the photosensitive body 1 is uniformly charged by scorotron 3 to, for example, (+ or −) about 500 to 800V.

The polarity of the charged voltage to be applied to the photo semiconductor layer 1*b* is optionally set according to an image forming system (positive development or reversal development) to form the electrostatic latent image on the photo semiconductor layer 1*b*, the material used for the photo semiconductor layer 1*b*, the charged polarity of the toner and the like.

The photosensitive body 1 is rotated at a predetermined number of revolutions N capable of reaching the traveling speed of the outer peripheral surface referred to as a process speed. The traveling speed of the outer peripheral speed, that is, a circumferential speed set by the number of revolutions and the diameter of the photosensitive body 1 is, to show one example, set to 220 mm/sec. The circumferential speed is also equivalent to the process speed.

The photosensitive body 1 charged to a predetermined potential is irradiated by the light corresponding to image information to be outputted by an exposure apparatus 5 provided at the downstream side of the rotational direction in which the photosensitive body 1 rotates in the vicinity of the charging apparatus 3 so that an electrostatic image (latent image) corresponding to the image information is formed. Incidentally, as for the exposure apparatus 5, for example, a laser beam exposure apparatus not described in detail which exposes the image by scanning the laser beam in the axial direction of the photosensitive body 1, a line LED which is not described in detail in which a plurality of LED elements are arranged linearly at a predetermined pitch and the like can be utilized.

The latent image formed on the outer periphery of the photosensitive body 1 by the exposure apparatus 5 is developed (visualized) with the toner selectively supplied from the developing liquid by a developing apparatus 7 which is provided at the downstream side of the direction in which the photosensitive body 1 rotates in the vicinity of the exposure apparatus 5 and which uses the liquid developer such as described below by FIG. 2. At a predetermined position around the developing apparatus 7 or in the vicinity thereof, though to be described in detail by using FIG. 2, a toner liquid circulation mechanism which replenishes the toner to be consumed in the developing area between the developing apparatus 7 and the photo semiconductor layer 1*b* of the photosensitive body 1 and circulates the developing liquid, in which the toner density is set constant, in the developing area is integrally provided.

In the developing area in which the developing apparatus 7 and the photo semiconductor layer 1*b* of the photosensitive body 1 are opposed, a developing bias voltage to allow the toner dispersed in the developing liquid to effectively perform electrophoresis is applied from a developing bias power supply 171.

The toner supplied to the latent image on the photo semiconductor layer 1*b* from the developing apparatus 7 and the (residual) solvent are conveyed accompanied with the rotation of the photosensitive body 1 in a state of being adhered to the latent image.

The toner to be conveyed accompanied with the rotation of the photosensitive body 1 (and the residual solvent) are guided to a drying area opposed to a drying blower 9 provided in the vicinity of the developing apparatus 7 at the downstream side of the direction in which the photosensitive body 1 rotates.

In the drying area opposed to the blower 9, practically all the solvents remained on the photosensitive body 1 are removed. The blower 9 blows, for example, an air of ordinary temperature which is not heated against the photosensitive body 1 from an opening being not described in detail at 5 m/sec.

The toner in which the solvent is mostly removed is moved, accompanied with the rotation of the photosensitive body 1, to an intermediate transferring body 11 located in the vicinity of the charging apparatus 3 at the downstream side of the direction in which the photosensitive body 1 rotates. The intermediate transferring body 11 is a cylindrical body having a diameter of about 104 mm with an urethane rubber layer having a rigidity of 20° (JIS-A scale) formed, for example, in the thickness of 2 mm on a metallic roller having a diameter, for example, of 100 mm. Further, the intermediate transferring body 11 exhibits a predetermined elasticity due to the urethane rubber layer on the surface and, at least on the occasion when the toner image is transferred, is pressed against the surface of the photosensitive body 1, that is, the photo semiconductor layer 1*b* and the toner.

Meanwhile, at a predetermined position between the blower 9 and the intermediate transferring body 11, a charge eliminating lamp 13 (which erases the charge remained on the photo semiconductor layer 1*b* and the charge retained by the toner) is provided which eliminates an electrostatic force between the toner and the photo semiconductor layer 1*b* immediately before the transferring area with which the intermediate transferring body 11 and the photo semiconductor layer 1*b* come into contact so that the toner (toner image) adhered on the photo semiconductor layer 1*b* by the electrostatic force between the latent image and the toner is reliably transferred on the intermediate transferring body 11.

At a predetermined position of the outer peripheral surface of the intermediate transferring body 11, for example, at a position shifted by a predetermined amount from the transferring position with which the intermediate transferring body 11 and the photosensitive body 1 into contact, a backup roller 15 to transfer the toner transferred on the photosensitive body 1 to a paper (transferring material) P is provided.

The backup roller 15 is an elastic body roller having a diameter, for example, of 100 mm provided with an urethane system rubber layer of a rigidity 5° by JIS-A scale. At an image forming time, the surface of the backup roller 15 is used in a state of being heated at about 80° C.

The backup roller 15 is arranged that the axis of the intermediate transferring body 11 and its own axis are substantially in parallel. The backup roller 15 is brought into contact with a predetermined position of the outer peripheral surface of the intermediate transferring body 11 at one point of the peripheral surface (linearly in the axial direction) with a predetermined pressure, for example, a load of about 8 $kg/cm^2$. Further, the backup roller 15 is pushed against the outer periphery of the intermediate transferring body 11 by the above described pressure so as to rotate in such a manner that the rotational direction at a position with which both of them into contact at the same speed as the traveling speed of the outer peripheral surface of the intermediate transferring body 11 becomes the same direction (the rotational direction is reverse when looked from an axial center). Accordingly, the toner conveyed by the intermediate transferring body 11 is transferred on the paper P which is supplied between the backup roller 15 and the intermediate transferring body 11 by the pressure defined by the pressure between the intermediate transferring body 11 and the backup roller 15 and a thickness of the paper P.

At the downstream side of the transferring area along which the intermediate transferring body 11 and the backup roller 15 run in parallel and come into contact in the direction in which the photosensitive body 1 is rotated, a section of the upper stream side upper than the charging apparatus 3 is provided with a cleaner 17 which eliminates the transfer residual toner remained (existing on the photosensitive body 1 without being transferred to the intermediate transferring body 11) on the surface of the photosensitive body 1. Accordingly, the transfer residual toner remained on the photo semiconductor layer 1*b* of the photosensitive body 1 is eliminated from the surface of the photo semiconductor 1*b* by the time when a predetermined potential is again supplied to the photo semiconductor layer 1*b* by the charging apparatus 3.

Meanwhile, for the cleaner 17, for example, there is an idea of using such a constitution that a brush in which hairs are arranged at a predetermined density, a sponge, a felt, rubber or the like is brought into contact with the photo semiconductor layer 1*b* of the photosensitive body 1 by a predetermined pressure.

The paper P in which the toner was transferred is supplied with a predetermined pressure and head from a fixing apparatus not shown so that the toner which was once melt is fixed (secured). The pressure supplied to the paper P and the toner by the backup roller 15 and the intermediate transferring body 11 is sufficiently large in contrast to an electrostatic system transferring (the system in which the transferring voltage is applied from the back of the paper P) and, when the transferring mechanism shown in FIG. 1 is used, the toner is firmly secured on the paper P and therefore the fixing apparatus can be omitted. Further, in the transferring area in which the paper P is pushed against the intermediate transferring body 11 by the backup roller 15 becomes possible to apply heat and pressure, the transferring mechanism served as a fixing apparatus (not shown).

Figure 6:
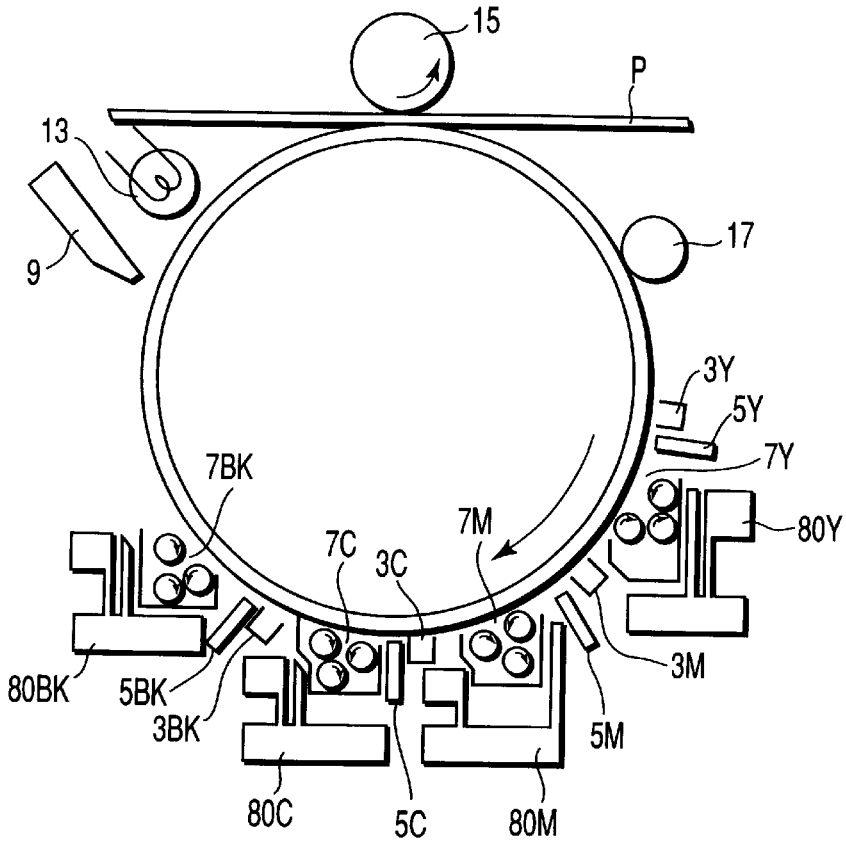
FIG. 6 is a schematic diagram for explaining an example in which the image forming apparatus using the liquid developer shown in FIG. 1 is applied to a color image forming apparatus.

Meanwhile, in the image forming apparatus shown in FIG. 1, before the developed image (toner image) is transferred on the paper P, as to be described at a subsequent column by using FIG. 6, though the description thereof was made with an example of an offset transferring system, wherein the toner image is once transferred to the intermediate transferring body 11, the toner image (developed image) may be directly transferred on the paper P without using the intermediate transferring body 11.

Further, in FIG. 1, an example is described, wherein, after the solvent is eliminated from the toner layer (toner image) obtained by developing the latent image, the toner image is transferred on the intermediate transferring body 11 by pressure or by heat and pressure. Further, the squeeze of the solvent by a first and a second squeeze rollers provided in the developing apparatus 7 to be described below by using FIG. 2 may be used only to eliminate a toner fog floating in a non-image portion on the photo semiconductor layer 1*b*. In this case, by applying a predetermined transferring electric field between the photo semiconductor layer 1*b* and the intermediate transferring body 11 and to the intermediate transferring body 11 in a state where the solvent remains in the toner image, each toner which forms the toner image can be drawn to the intermediate transferring body 11 by the electrophoresis similarly to the case where the latent image is developed.

Next, a constitution of the developing apparatus will be described with reference to FIG. 2.

The developing apparatus 7 includes: a developing roller 71 which supplies a developing liquid comprising toner and solvent to the electrostatic latent image formed on the photo semiconductor layer 1*b* of the photosensitive body 1; a housing 72 which houses a predetermined amount of developing liquid and, retains the developing liquid while supplying a predetermined amount of developing liquid to the surface of the developing roller 72; a first squeeze roller 73 which squeezes the solvent from the developing liquid adhered on the latent image formed on the photo semiconductor layer 1*b*; a second squeeze roller 74 which squeezes the solvent remained on the toner layer in which the solvent was substantially squeezed by the first squeeze roller 73; a conductivity adjustment roller 75 capable of controlling the conductivity of the developing liquid; a cleaning roller 76 which cleans the surface of the developing roller 71; and a toner liquid circulation mechanism 80 to replenish the toner in the developing liquid consumed by the developing the latent image and the like.

The developing roller 71 is a roller body made from, for example, a stainless steel or an aluminum having, for example, a diameter of 17 mm.

The developing roller 71 is rotated by a developing motor 173 in the same direction (that is, the rotational direction of the rotation axis is reverse) as the direction in which the outer peripheral surface is moved at a position opposed to an optional position of the surface of the photosensitive body 1.

The developing roller 71 is rotated in an arrow mark direction so that it moves at a predetermined speed for the peripheral speed of the photosensitive body 1, for example, a speed of a peripheral speed ratio 1 to 3. In order to rotate the developing roller 71, in place of the developing motor 173, a drum motor (not shown) which rotates the photosensitive body 1 and a rotation transfer mechanism not shown are sometimes utilized.

The developing roller 17 is opposed to the peripheral surface of the photo semiconductor layer 1*b* of the photosensitive body 1 shown in FIG. 1 at an interval of 50 to 200 $\mu$m, for example, at an interval of 150 $\mu$m. The developing liquid is supplied to the developing roller 71 from a nozzle 81*a* provided on the tip of a tank 81 of the toner liquid circulation mechanism 80 to be described in a subsequent column. An amount of the developing liquid supplied to the nozzle 81*a* is defined by a delivery rate by a pump 83. The developing liquid supplied to the developing roller 71 is supplied to a developing area defined between the developing roller 71 and the photosensitive body 1 with the developing roller 71 rotated. That is, the developing liquid is filled in a space between the photo semiconductor layer 1*b* of the photosensitive body 1 and the developing roller 71.

The surface of the developing roller 71 is applied with a developing bias of about 100 to 800V with a predetermined polarity of + or − by the developing bias electric power supply 171 according to an image forming system (positive development or reversal development) to form the electrostatic latent image on the photo semiconductor layer 1*b*, the material of the photo semiconductor layer 1*b*, the charged polarity of the toner and the like.

The toner in the developing liquid filled in the space between the developing roller 71 and the photo semiconductor layer 1*b* performs an electrophoresis toward the photo semiconductor layer 1*b* by the electric field which is retained by the latent image formed on the photo semiconductor layer 1*b* and the developing bias voltage. In this way, the latent image is selectively supplied with the toner. Incidentally, at this point of time, around each of the toner particles adhered on the latent image, the large amount of solvent remains. Further, in the developing area, as for the non-image portion of the photo semiconductor layer 1*b* where the electrostatic latent image does not exist, the toner migrates toward the developing roller 71 by the potential difference in the opposite direction to the image portion defined by the potential of the photo semiconductor layer 1*b* which retains the charged potential as it is and the developing bias voltage applied to the developing roller 71. In this case, the counter ion that makes a pair with the charge retained by the toner in the developing liquid migrates toward the photo semiconductor layer 1*b* of the photosensitive body 1.

The first squeeze roller 73 is a roller formed with, for example, a diameter of 17 mm by, for example, stainless steel and the like.

The squeeze roller 73 is located in a predetermined position inside the housing 72 at the downstream side of the direction further than the developing roller 71 in which the photosensitive body 1 is rotated with, for example, a gap of about 50 $\mu$m given between itself and the photo semiconductor layer 1*b*.

The first squeeze roller 73, with the driving force from a developing motor 131 to the developing roller 71 transmitted via, for example, gear and/or gears (not shown), is rotated by 2 to 4 times the number of rotations, preferably by the number of rotations capable of supplying preferably 2.5 times the traveling speed in comparison at which the outer peripheral surface of the photosensitive body 1 is moved in the direction reverse to the direction in which the outer peripheral surface of the photosensitive body 1 is moved, for example, in a state of being seen at a position opposed to the outer peripheral surface of the photosensitive body 1 (the rotational direction of the photosensitive body 1 seen from the rotation center thereof and the rotational direction of the first squeeze roller 73 seen from the rotation center thereof are the same). The first squeeze roller 73 is applied with 100 to 600V with a predetermined polarity of + or −, or with the voltage of 500V to show one example, by a first squeeze roller bias power supply 175 according to the image forming system (positive developing or reversal developing) to form the electrostatic latent image on the photo semiconductor layer 1*b*, the material used for the photo semiconductor layer 1*b*, the charged polarity of the toner and the like. Further, the surface of the first squeeze roller 73 is subjected to kanizen plating or Tufram treatment (trade name) or provided with a thin insulating film 73*a* formed with fluorocoat and the like in order to prevent generation of a discharge between itself and the photo semiconductor layer 1*b* of the photosensitive body 1 due to application of the developing bias voltage from the developing bias power supply 171.

The second squeeze roller 74 is, for example, such that an elastic member such as rubber showing conductivity with a specific resistance controlled to about $10^7$ to $10^{12}$ $\Omega cm^2$ is made roller-shaped on the axis formed by a stainless steel and the like, and the outside most periphery thereof is provided with a silicon based tube having a predetermined thickness as a solvent-resistance (solvent) preventive layer. The roller 74 is located at a predetermined position of the housing 72 or in the vicinity of the housing 72. Further, the diameter of the roller 74 is defined to be about 20 mm including the tube.

Further, the second squeeze roller 74 is brought into contact with the photo semiconductor layer 1*b* of the photosensitive body 1 so that the tube and/or the elastic member is formed in such a manner as to have hardness slightly deformable.

Meanwhile, by bringing the roller 74 into contact with the photo semiconductor layer 1*b* of the photo-sensitive body 1 with a predetermined contact pressure so that the hardness is set to optimum, a nip of 1 to 2 mm between itself and the photo semiconductor layer 1*b* is developed. Further, the roller 74 is a non-drive roller and, by being brought into contact with the photo semiconductor layer 1*b* of the photosensitive body 1, the moving direction of the outer peripheral surface at a contact position is rotated in the same direction as the moving direction of the photo semiconductor layer 1*b* without a circumferential speed difference (at the same speed as the moving speed of the photo semiconductor layer 1*b*). The surface of the tube is applied with a voltage of approximately 800V with a predetermined polarity + or − by a second squeeze roller bias power supply 177 by corresponding to an image forming system (positive developing or reversal developing) to form the electrostatic latent image on the photo semiconductor layer 1*b* or the material to be used for the photo semiconductor layer 1*b*, the charged polarity of the toner and the like.

The conductivity adjustment roller 75 is a metallic roller such as stainless steel or aluminum having, for example, an outer diameter formed in 15 mm. At an ordinary image forming time, the conductivity adjustment roller 75 is put in a floating (electrically insulated) state and is applied with a predetermined conductivity adjustment voltage in a conductivity adjustment mode to be described in the subsequent column with reference to FIG. 3. The conductivity adjustment roller 75 is arranged by opposing to the developing roller 71 so that a space between the surface of the developing roller 71 and the surface of itself becomes 50 to 200 $\mu$m, preferably 200 $\mu$m and is rotated preferably at a circumferential speed ratio of 1 to 2, preferably at 1 (without the circumferential speed difference) in the same direction as the direction in which the developing roller 71 is rotated or in the reverse direction thereof.

The cleaning roller 76 is an elastic roller in which a sponge such as urethane and the like is provided with a predetermined diameter around an axis (not shown) and is provided at the downstream side further than the conductivity adjustment roller 75 in the direction in which the developing roller 71 is rotated and brought into contact with the outer peripheral surface of the developing roller 71 at a predetermined pressure. The roller 76 is for returning the residual toner (developing liquid) not used for developing (visualizing) the latent image (remained on the surface of the developing roller 71) by rotating at a predetermined speed. In this case, the cleaning roller 76 may be applied with a bias for improving a cleaning property by being formed, for example, by a conductive urethane and the like. Further, it is needless to say that it may not necessarily be in a roller shape but, for example, in a blade shape.

The toner liquid circulation mechanism 80 is provided at the end of the tank 81 which houses the toner liquid returned from the housing 72 of the developing apparatus 7 and the toner liquid to be supplied to the developing roller 71 and includes: a replenishment toner tank 82 which houses a condensed toner liquid to be replenished to a nozzle 81*a*, the tank 81 supplying the developing liquid between the developing roller 71 and the photosensitive body 1; a pump 83 which delivers the toner liquid inside the tank 81 toward the developing roller 71; a toner liquid return passage 84 which returns the toner liquid after developing the latent image from the housing 72 to the tank 81; a conductivity measuring apparatus 85 which is provided at a predetermined position inside the tank 81 and measures the conductivity of the liquid toner; a toner density sensor 86 which is provided at a predetermined position inside the tank 81 and detects the toner density inside the toner liquid; a replenishment control valve 87 which controls the amount of the condensed toner liquid to be replenished from the replenishing toner tank 82 to the tank 81; a toner replenishment controller 88 which controls application of the conductivity adjustment voltage to the conductivity adjustment roller provided inside the housing 72, a driving of the pump 83, an uptake of a measuring result of conductivity from the conductivity measuring apparatus 85, an uptake of a toner density signal from the toner density sensor 86 and ON/OFF of the replenishment control valve 87. The tank 81 is provided with an agitating mechanism (not shown) which agitates the toner liquid housed inside the tank 81 and the condensed toner liquid supplied from the replenishment toner tank 82.

The conductivity adjustment roller 75 is selectively connectable to a conductivity adjustment power supply 179 through a switch 77 and, the switch 77 is turned ON/OFF by the control of the toner replenishment controller 88 so that a float and/or voltage application is switched.

The conductivity detection apparatus 85 is a known conductivity sensor, and detects the conductivity of the developing liquid in the tank 81.

The toner density sensor 86 is, for example, an optical density sensor (which has an emission source for radiating a light of a predetermined wavelength and optical intensity and a light receiving element capable of outputting an electrical signal corresponding to the optical intensity of an incident light and which outputs a degree by which a light from the emission source reaches the light receiving element) or a supersonic wave system density sensor (capable of outputting an electrical signal corresponding to the sound source which outputs a supersonic wave of a predetermined frequency and a magnitude of the incident supersonic wave) and is located inside the developing liquid housed inside the tank 81.

In such developing apparatus 7, the latent image irradiated and formed by the light corresponding to the image by the exposing apparatus 5 on the photo semiconductor layer 1*b* of the photosensitive body 1 which is charged to a predetermined potential by the charging apparatus 3 is guided to the developing area accompanied with the rotation of the photosensitive body 1 so that the developing roller 71 of the developing apparatus 7 is rotated at a predetermined speed. That is, the developing area between the photo semiconductor layer 1*b* of the photosensitive body 1 and the developing roller 71 is supplied and filled with the toner liquid inside the tank 81 which is delivered by the pump 83, through the nozzle 81*a*.

Figure 3:
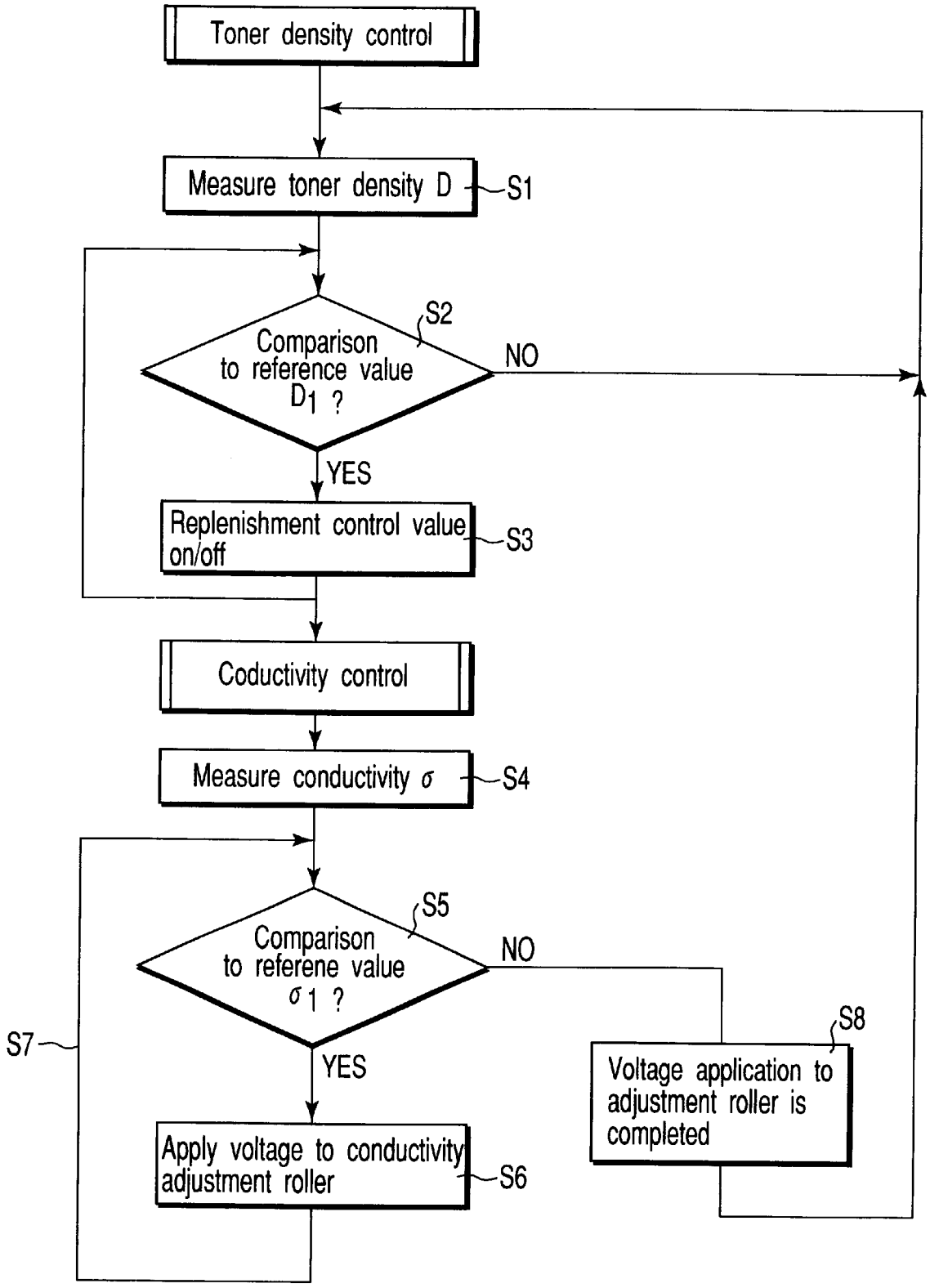
FIG. 3 is a schematic flowchart for explaining one example of a toner density control mechanism usable for the liquid developing apparatus shown in FIG. 2.

Although to be described in the subsequent column by using FIG. 3, the toner liquid housed inside the housing 72 is circulated between the housing 72 of the developing apparatus 7 and the tank 81 of the toner liquid circulation mechanism 80 by activating the pump 83 of the toner liquid circulation mechanism 80 at the time of image forming and toner liquid replenishment. Here, the toner liquid supplied to the housing 72 is eliminated from contaminants by a slit (not shown) or a filter (not shown) through which toner particles can pass.

Further, the toner liquid circulated between the toner liquid circulation mechanism 80 and the housing 72 by the toner liquid circulation mechanism 80 is replenished by a portion of the toner consumed by developing the latent image with the condensed toner liquid replenished, and the toner density is controlled to a predetermined toner density.

In the developing apparatus 7, the developing liquid (liquid developer) is used, wherein the toner pigmented with a predetermined color is dispersed in a carrier liquid (solvent) which primarily includes, for example, petroleum non-polarity solvent.

The toner primarily includes color agent (pigment) and binding resin, which are particles having the charged polarity controlled to a predetermined polarity (+ or −) by the charge control agent (additive) corresponding to the image forming system (positive developing or reversal developing) to form the electrostatic latent image on the photo semiconductor layer 1*b*, the material used for the photo semiconductor layer 1*b* and the like, and which are formed in a shape similar to a nearly spherical form having an average particle size defined to be 0.1 to 3 $\mu$m and are dispersed in a solvent by a weight percentage of 0.5 to 5 (wt%), or more preferably by the weight percentage of 1 to 3 (wt%). Accordingly, the ionic species (ion source) dispersed in the developing liquid are the charged toner, the counter ion which has the same potential as the toner but is reverse in polarity and the ion (excessive-ion having + or −) attributable to a disassociated charge control agent, contaminants and the like which are not adhered on the toner particles and floated.

The ionic species (ion source) in the toner liquid which are delivered to the developing area, that is, the toner and the counter ion receive a force by an electric field formed by the latent image and the developing bias voltage and adhere on the electrode corresponding to each polarity, that is, the electrode which makes an electrophoresis toward the photo semiconductor layer 1*b* or the developing roller 71.

With regard to the image portion of the photo semiconductor layer 1*b*, the toner adheres on the latent image formed on the photo semiconductor layer 1*b* and is carried away from the developing area accompanied with the rotation of the photosensitive body 1. Finally, the toner is transferred on a transferring medium, that is, a paper and consumed. On the other hand, the counter ion having a reverse polarity adheres on the developing roller 71, and the charge is vanished by transfer of the charge (charge injecting to the developing roller 71) between itself and the surface of the developing roller 71. That is, the same amount of toner and counter ion is vanished so that a balance of the ion in the developing liquid can be maintained.

In contrast, in the non-image portion, the toner adheres on the surface of the developing roller 71 and the counter ion adheres on the photo semiconductor layer 1*b* of the photosensitive body 1. However, since it is considered that the charge of the toner is generated due to bonding of the charge control agent on a charged site of the binding resin which constitutes the toner, the transfer of the charge (charge injecting) is not generated between the toner which reached the developing roller 71 and the surface of the developing roller 71.

Similarly, since the photo semiconductor layer 1*b* of the photosensitive body 1 is a dielectric, the transfer of the charge (charge injection) between the counter ion and the photo semiconductor layer 1*b* is not generated. Accordingly, in the non-image portion, the ion is not vanished.

Needless to say, the transfer of the charge is not possible for the excessive-ion regardless of whichever electrode it reaches.

Next, one example of the method of replenishing the toner which was consumed by developing the latent image formed on the photo semiconductor layer of the photosensitive body will be described by using FIG. 3.

As described above, by repeatedly developing the latent image, the toner and the counter ion are consumed by the same amount, but the amount of excessive-ion is constant.

On the other hand, in order to maintain the toner density in the developing liquid within a fixed range, a method is widely used by using the toner density sensor 86 in general, wherein the condensed toner, in which the toner is dispersed by a density of 10 to 40 times the toner density in comparison with the toner liquid used when the latent image is actually developed, is replenished by a portion of the toner that was consumed.

For example, when the toner density of the toner liquid detected by the toner density sensor 86 and inputted to the controller 88 is determined to be lower than a predetermined toner density by the controller 88, an ion signal for replenishing the condensed toner from the condensed toner tank 82 is sent to the replenishment control valve 87 from the controller 88 and the replenishment control valve 87 is released continuously several times or for a predetermined time.

By the way, to replenish the toner is to replenish the toner density wherein, while the toner and the counter ion are consumed, the toner liquid, in which the excessive-ion is contained in the same amount as the initial toner liquid, is added with an adequate amount of the condensed toner while monitoring the toner density so as to replenish the toner density. In this case, an amount of charge auxiliary agent (charge control agent), which is required according to solid content (total amount of the toner), is added in advance to the condensed toner liquid. Further, in the condensed toner liquid also, the ionic species (ion source) are the charged toner, the counter ion and the ion (excessive-ion having + or −) attributable to the disassociated charge control agent and the like which are not adhered on the toner particles and floated, and a ratio of the amount of excessive-ion to the toner is equal to a ratio of the amount of excessive-ion to the tone r in the initial toner liquid.

However, since the excessive-ion contained in the condensed toner liquid is also added by a predetermined amount by the addition of the condensed toner liquid, the amount of excessive-ion in the toner liquid is increased in comparison with the initial toner liquid. Incidentally, due to the increase of the amount of the excessive-ion, the conductivity of the toner liquid maintained inside the housing 72 is also increased.

For this reason, as shown in FIG. 3, it is necessary to monitor the toner density of the toner liquid supplied to the developing roller 71 inside the tank 81 of the toner liquid circulation mechanism 80 and to supply the toner liquid which is set to a predetermined toner density to the developing roller 71.

To describe in details, a toner density D of the toner liquid in the tank 81 is measured by the toner density sensor 86 (S1), and a reference value $D_1$ of the predetermined toner density and the toner density D measured by step Si are compared with each other (S2).

In step S2, when the measured toner density D is smaller (lightly) than the reference value $D_1$ (S2—Yes), the replenishment control valve 87 is turned ON for a predetermined time by control of the controller 88, and a predetermined amount of condensed toner liquid is replenished from the condensed toner tank 82 to the tank 81 (S3).

Next, the conductivity σ of the toner liquid inside the tank 81 replenished with the condensed toner is measured by the conductivity measuring apparatus 85 (S4), and the conductivity σ of the current toner liquid measured by step S4 and the predetermined conductivity $\sigma_1$ of the toner liquid decided in advance are compared (S5).

In Step SS, when the measured conductivity σ is larger (higher) than the reference value $\sigma_1$ (S5—Yes), the switch 77 is activated by control of the controller 88 and a predetermined conductivity adjustment voltage is applied to the conductivity adjustment roller 75 (S6).

Subsequently until the conductivity σ becomes equal to the reference value $\sigma_1$ or smaller (lower) than the reference value $\sigma_1$, the application of the conductivity adjustment voltage to the conductivity adjustment roller 75 and the measurement of the conductivity σ are continued (S7).

When an energization to the conductivity adjustment roller 75 by step S7 is continued and the conductivity σ to be measured by step S7 becomes equal to the reference value $\sigma_1$ or smaller (lower) than the reference value $\sigma_1$ (5S—No), the switch 77 is turned off by control of the controller 88 and the conductivity adjustment roller 75 is returned again to a float state (S8).

Next, one example of a step of adjusting the conductivity of the toner liquid by the conductivity adjustment roller 75 will be described.

In step S5 shown in FIG. 3, when the conductivity a of the toner liquid is detected to be higher (larger) than the reference value $\sigma_1$, the switch 77 is activated by control of the controller 88 and a predetermined conductivity adjustment voltage is applied to the conductivity adjustment roller 75. It is needless to say that the polarity and the magnitude of the conductivity adjustment voltage to be applied to the conductivity adjustment roller 75 is randomly set according to the image forming system (positive development or reversal development) to form the electrostatic latent image on the photo semiconductor layer 1*b* of the photosensitive body 1 as described earlier or the material used for the photo semiconductor layer 1*b*, the charged polarity of the toner and the like.

Hereinafter, description will be given for one example of lowering the conductivity σ of the toner liquid so that it becomes equal to the reference value $\sigma_1$ or smaller than the reference value $\sigma_1$ by applying a predetermined conductivity adjustment voltage to the conductivity adjustment roller 75.

At the time of the usual image forming action, the toner liquid which is not used for developing the latent image of the photo semiconductor layer 1*b* of the photosensitive body 1 is returned inside the housing 72 accompanied with the rotation of the developing roller 71.

On that occasion, much of the toner liquid is maintained on the surface of the developing roller 71 at a predetermined thickness and returned to the housing 72. Accordingly, almost all the toner liquid passes through the space to which the conductivity adjustment roller 75 and the developing roller 71 oppose. In an ordinary state, the conductivity adjustment roller 75 is in a float state and therefore the toner liquid is returned to the housing 72 (tank 81) as it is.

In contrast to this, when the conductivity of the toner liquid is raised (increased) as a result of the replenishment of the condensed toner liquid to the toner liquid where the toner was consumed, according to the measured result of the conductivity of the toner liquid by the conductivity measuring apparatus 85, the switch 77 is instructed to switch on by the controller 88. In this way, the conductivity adjustment power supply 179 and the conductivity adjustment roller 75 are connected to each other. Accordingly, the conductivity adjustment roller 75 is supplied with the conductivity adjustment voltage of, for example, ±50 to 500V having a predetermined polarity which is set according to the material used for the photo semiconductor layer 1*b* and the charged polarity of the toner. The conductivity measuring apparatus 85 may be always acting or acting only when the replenishment toner is supplied.

With a predetermined conductivity adjustment voltage applied to the conductivity adjustment roller 75, a predetermined potential difference is generated between the developing roller 71 applied with the developing bias and the conductivity adjustment roller 75.

Accompanied with this potential difference, the toner in the toner liquid which passes through between both rollers 71, 75 makes an electrophoresis to the side of the developing roller 71 and the counter ion to the side of the conductivity adjustment roller 75, respectively. Accordingly, the charge of the counter ion that reached the conductivity adjustment roller 75 is vanished by charge injecting to the conductivity adjustment roller 75. In this way, the conductivity σ inside the toner liquid is reduced.

In this way, when the counter ion (excessive-ion), which exists in the toner liquid, increases so as to increase the conductivity of the toner liquid, by electrically vanishing the counter ion (excessive-ion) existing in the toner liquid within the inside of the tank 81 of the circulation mechanism 80 or within the inside of the housing 72 of the developing apparatus 7, the increase (rise) of the conductivity of the toner liquid due to influence of the counter ion (and the excessive-ion) contained in the toner liquid can be prevented. Needless to say, as far as the conductivity adjustment roller 75 is capable of supplying the potential difference which can draw the counter ion to itself between the developing bias voltage and itself, no restriction is imposed on its shape and/or its position.

Further, the conductivity control voltage to be applied to the conductivity control roller 75 may be an AC voltage.

When the AC voltage is used for the conductivity control voltage, for example, the magnitude of a DC voltage to be superposed has a potential difference of 50 to 800V for a counter-electrode and has the same polarity as that of the toner potential and is preferably, for example, 100V to 800V in peak to peak. On this occasion, assuming that a peak to peak voltage of the AC voltage is Vpp [V] and a distance between the developing roller 71 and the conductivity control roller 75 (conductivity control electrodes) is d [m], it is desirable to satisfy a condition which is $\lambda > \mu(Vpp/2)/d^2$ between the frequency $\lambda$ [Hz] of the AC voltage and the mobility $\mu$ of the toner.

By satisfying the conductivity adjustment voltage which is $\lambda > \mu(Vpp/2)/d^2$, due to influence of the toner adherence (electrolytic deposition) to the conductivity adjustment roller which is generated when the voltage applied to the conductivity adjustment roller 75 is direct current, the lowering of an ability to vanish the counter ion in a short time can be prevented. That is, by setting a switching cycle of the voltage rapidly (in a short time) than the traveling speed of the toner, which is moved between the conductivity adjustment roller 75 and the developing roller 71 according to the frequency of the AC voltage, the adherence of the toner on the surface of the conductivity adjustment roller 75 and the surface of the developing roller 71 can be prevented, so that the situation where the surfaces of both rollers have to be cleaned can be eliminated.

Since the charge of the counter ion (excessive-ion) is vanished immediately at the moment when it comes in contact with the conductivity adjustment roller 75, it is possible to lower the conductivity of the toner liquid regardless of the frequency of the AC voltage.

Figure 4:
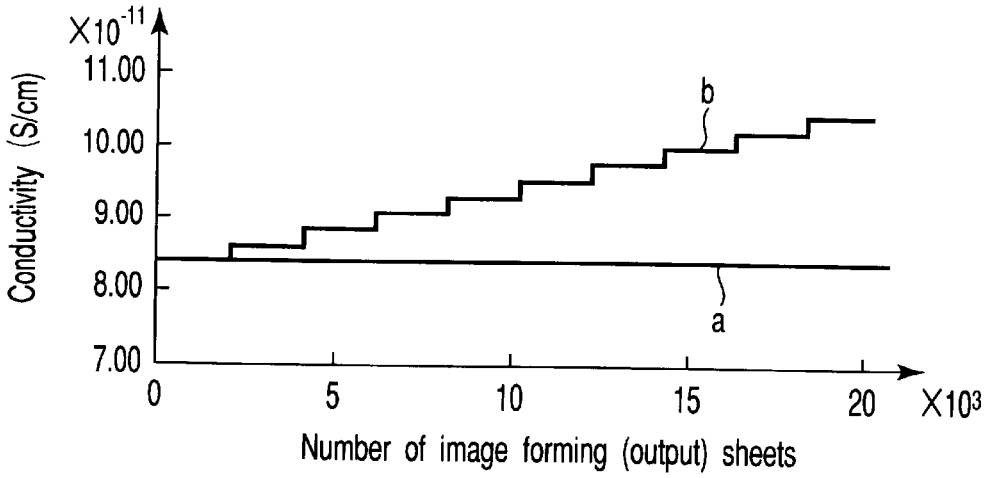
FIG. 4 is a schematic diagram for explaining a change of conductivity inside the developing liquid controlled by the toner density control mechanism shown in FIG. 3.

FIG. 4 is a schematic diagram showing the change of the conductivity of the toner liquid in which the toner liquid is replenished by the method for replenishing the condensed toner while controlling the conductivity shown in FIG. 3. A curve a shows the change of the conductivity by the replenishment of the condensed toner by using the conductivity adjustment roller of the present patent invention, and a curve b shows the change of the conductivity of the toner liquid in the case where the replenishment of the toner is simply continued.

Further, the conditions of the curve a and the curve b shown in FIG. 4 show the result in which the image forming apparatus shown in FIG. 1 is used and the image forming is repeated as a running test for the image having an image ratio of 5% and an A4 size and the condensed toner is replenished every 2000 sheets (2 k sheets).

The conductivity of the initial state of the above described toner liquid is $8.1\times10^{-11}$ [S/cm]. Further, the toner mobility measured by a Z potential measurement apparatus ESA9800 (made by MATEC APPLIED SCIENCES CORP.) is $2.0\times10^{-9}$ [$m^2$/Vs].

Meanwhile, with ISOPER L (made by EXXON CORP.) taken as a non-polarity solvent and methacrylic acid methylacrylic acid butyl co-polymer resin having a glass transition point Tg of 50° C. and a pigment of blue series taken as toner, the toner is added with a dispersing agent, and after it is mixed and dispersed together with ISOPER L by a paint shaker intervened with a glass beam to obtain a condensed developer, the toner liquid is used, which is diluted so that the density of non-volatile matter become one weight portion and wherein naphthenic acid zirconium (made by DAINIPPON INK AND CHEMICALS, INCORPOTRATED) is added so that it becomes 10 weight portions for the non-volatile matter of the above described condensed developer.

Further, with regard to the pigment which constitutes the toner, Cyanin blue (KRO made by Sanyo Color Works, Ltd.) is used and a weight ratio of the resin and the pigment is taken as 4:1.

It is known from the curve b that there is no change in the conductivity of the developing liquid even when the toner is consumed if the toner is not replenished, and the conductivity is increased after the replenishment of the toner. However, as shown in the curbed line B, as a result of the replenishment of the toner, the conductivity of the toner increases to $10.5\times10^{-11}$ [S/cm]. Incidentally, though not shown, the obtained image has a fine-line image flowed into a blowing direction of the blower 9 and is not minute.

In contrast to this, the curve a shows the result that the condensed toner is replenished every 2000 sheets (2 k sheets) and the bias voltage which becomes 800V is applied to the developing roller 71 and, further, a predetermined conductivity control voltage, for example, the AC voltage Vpp having a frequency of 20 Hz and a peak to peak voltage of 400V is applied between the conductivity control roller 75 and the developing roller 71 and, according to the flowchart shown in FIG. 3, the conductivity of the toner liquid is controlled so that the conductivity $\sigma$ of the toner liquid becomes equal to the reference value $\sigma_1$ or smaller (lower) than the reference value $\sigma_1$ thereby forming 20,000 sheets (20 k sheets). The frequency $\lambda$ of the AC voltage is satisfied by $\lambda > \mu(Vpp/2)/d^2$ since the toner mobility is taken as $2\times10^{-9}$ [$m^2$/Vs] and the distance d between the conductivity adjustment roller 75 and the developing roller is taken as $2\times10^{-4}$ [m].

As evident from the curve a, it is confirmed that, while the conductivity of the toner liquid is $8.1\times10^{-11}$ [S/cm] in the initial value, it is $7.8\times10^{-11}$ [S/cm] also at the end of the image forming. Incidentally, though not shown, the obtained image has a fine-line image, which does not flow into the blowing direction of the blower 9, and it is a high definition image.

As evident from FIG. 4, it is recognized that, by executing the conductivity adjustment of the present patent invention when the condensed toner is replenished, the conductivity inside the toner liquid does not change.

That is, by executing a conductivity adjustment mode each time the condensed toner is replenished and allowing the conductivity of the toner liquid to come closer to the initial value (to be lowered to the initial value), the conductivity of the liquid toner can be prevented from undesirably increasing and lowering the minuteness of the image. Further, since the method of controlling the conductivity of the toner liquid according to the present patent invention is practically not required to take into consideration a time required until the charged amount of the toner is stabilized in contrast to the method of managing the amount of the charge control agent which is added while measuring the conductivity as disclosed in Jpn. Pat. Appln. KOKOKU Publication No. 8-30921, there is no fear of interrupting a continuous image forming action for a long period of time.

As described above, the developing roller 71 and the conductivity adjustment roller 75 are arranged at a predetermined interval and a predetermined potential difference is applied between both rollers 71, 75 in a state of the toner liquid being interposed between both rollers 71, 75. Thus, the conductivity adjustment roller side has the same polarity as the charged potential of the toner, the counter ion and the excessive-ion having the same polarity as the toner are moved to the conductivity adjustment roller 75 side, and the toner and the excessive-ion having the same polarity as the toner are moved to the developing roller 71 side, and the charge of the counter ion moved to the conductivity adjustment roller side is neutralized and vanished by charge injecting from the conductivity adjustment roller. In this way, the amount of the excessive-ion can be controlled to a specified amount or less, and the electrostatic latent image is vanished or the generation of the image defect such as flowing into the non-image portion can be prevented before the developed toner is solidified.

Figure 2:
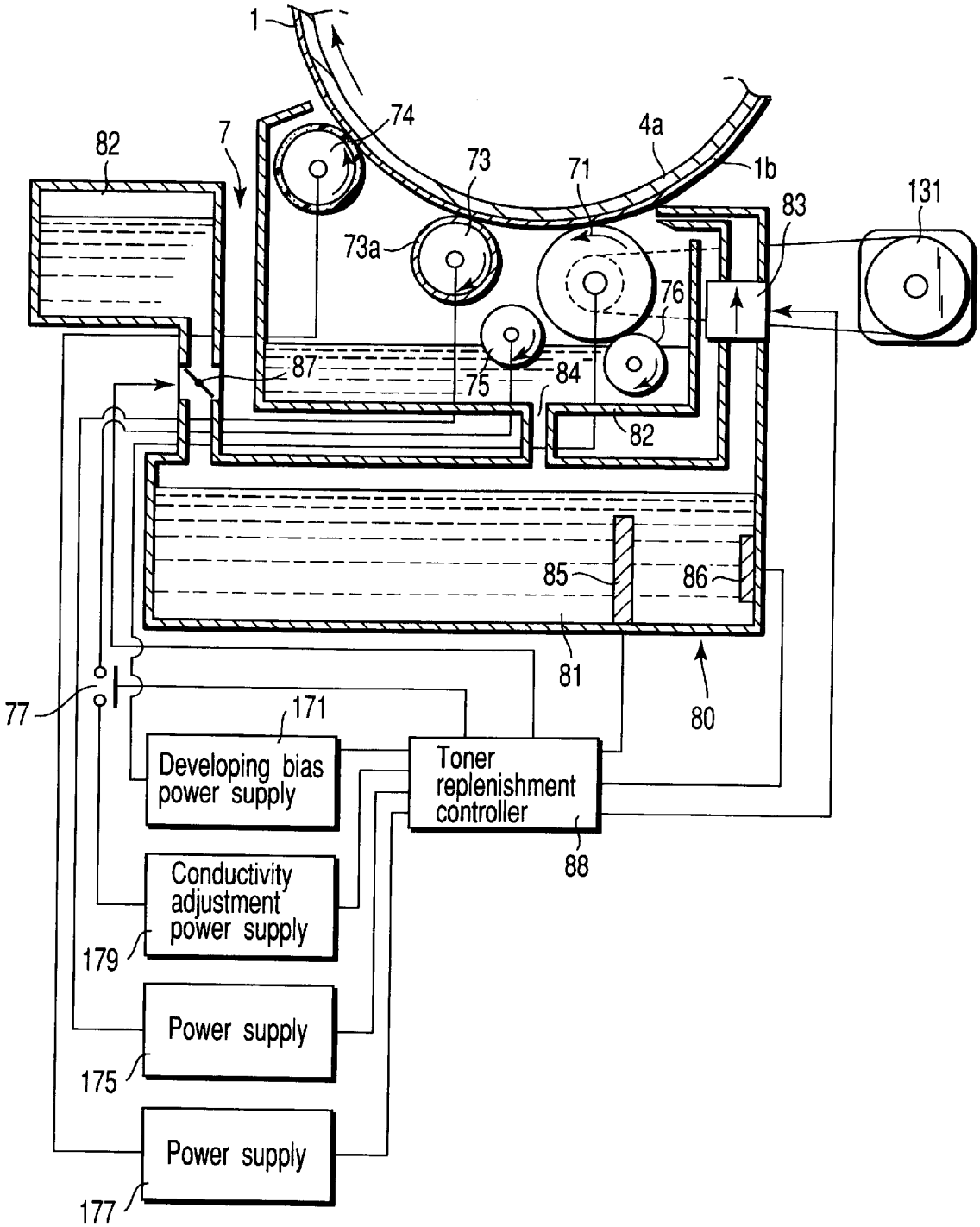
FIG. 2 is a schematic diagram for explaining one example of a liquid developing apparatus usable in the image forming apparatus shown in FIG. 1.
Figure 5:
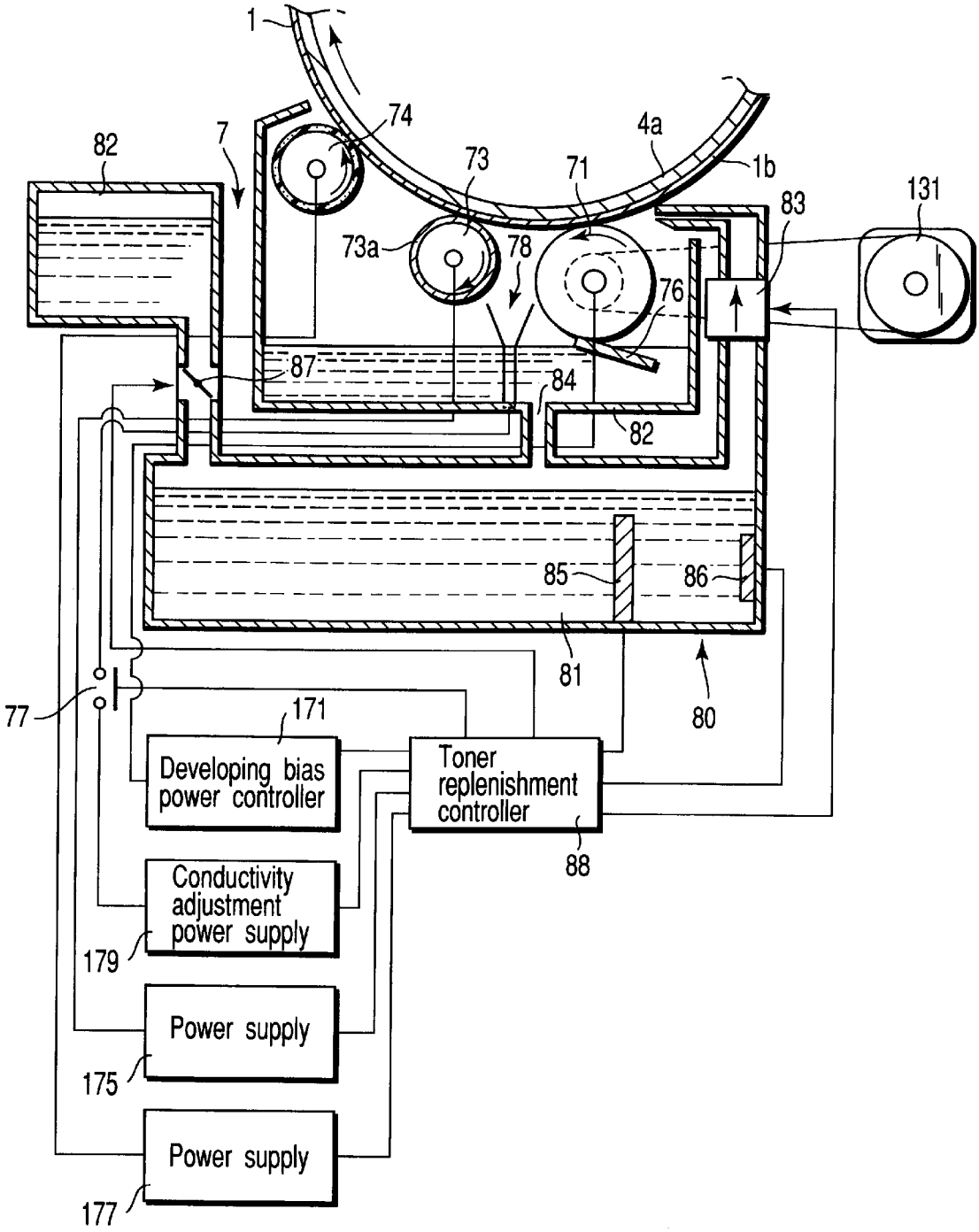
FIG. 5 is a schematic diagram for explaining another example of the liquid developing apparatus usable for the image forming apparatus shown in FIG. 1.

FIG. 5 is a schematic diagram explaining another embodiment of the developing apparatus (toner circulation mechanism) shown in FIG. 2. The constitution same as the constitution described earlier by using FIG. 2 is attached with the same reference numerals and the description thereof will be omitted.

A conductivity control unit 78 shown in FIG. 5 is constituted in such a manner that the conductivity control roller 75 opposed to the developing roller 71 in the developing apparatus 7 shown in FIG. 2 is made to be two independent electrode plates which are not opposed to the developing roller 71.

Each electrode plate is made of stainless steel having a smooth surface and is in a plate shape of 50 ×70 mm having a thickness of, for example, 1.0 mm and is opposed to each other at an interval of 200 $\mu$m ($d=2\times10^{-4}$ [m]). Incidentally, (the conductivity control apparatus 78) is located at a predetermined position inside the housing 72 so that almost all of the toner or at least a portion thereof which is returned to the inside of the tank 81 from the surface of the developing roller 71 and the surface of the squeeze roller 7 can pass through between both electrode plates. That is, the conductivity control unit 78 is arranged so that almost all of the toner liquid can pass through (own) electrode plates in the midst of the circulation route where the toner liquid is circulated.

Under the same condition as described above by using the developing apparatus 7 and the toner liquid circulation mechanism 80 shown in FIG. 5, that is, the condition where the condensed toner liquid is replenished every 2000 sheets, the AC voltage Vpp having a frequency of 20 Hz and a peak to peak voltage of 400V is applied and the conductivity of the toner liquid is controlled so that the conductivity $\sigma$ of the toner liquid becomes equal to the reference value $\sigma_1$ or smaller (lower) than the reference value $\sigma_1$, the images of 20,000 sheets (20 k sheets) were formed. In this example, a black toner showing a mobility $\mu$ of $5\times10^{-9}$ [$m^2$/Vs] and the initial value of $9.6\times10^{-11}$ of the conductivity of the toner liquid is used. Further, in this example, it is not necessary to provide the potential difference between the conductivity control unit 78 and the developing roller 71 and, therefore, the direct current component that needs to be superposed on the alternating current component is not necessarily required.

In the conductivity control unit 78 shown in FIG. 5, if the frequency $\lambda$ of the AC voltage to be applied to each electrode is 20 Hz, the toner thickly adheres on each electrode plate and it was not possible to generate an electrode reaction which can adjust the conductivity. Although this is a reference value, the conductivity of the toner liquid at a point of time when the image forming of 20,000 sheets has been completed is increased to $10.7\times10^{-11}$ [S/cm].

Then, the frequency $\lambda$ is changed to 30 Hz, and the image of 20,000 sheets are outputted similarly. In this case, the toner does not adhere to each electrode of the conductivity control unit 78, and the conductivity of the toner liquid at a point of time when the image forming of 20,000 sheets has been completed is $9.5\times10^{-11}$ [S/cm], thereby minute images can be continuously obtained.

FIG. 6 is a schematic diagram to explain one example wherein the developing apparatus described by using FIG. 2 is arranged in four sets around the photosensitive body 1 so as to constitute a color image forming apparatus. In FIG. 6, the constitution same or similar as the constitution described by using any one of FIGS. 1, 2 and 5 is attached with the same reference numerals and the description thereof will be omitted. Further, the components provided in four sets for the color image forming apparatus are attached with Y, M, C and BK for identification's sake and the description thereof will be omitted.

As shown in FIG. 6, around the photosensitive body 1, first to third developing apparatuses 7Y, 7M, and 7C to maintain the developing liquid including pigments exhibiting Yellow (Y), Magenta (M) and Cyan (C), respectively which are three color components to form a color image by using subtractive primaries and a fourth developing apparatus 7BK to emphasize a BK (black) and maintain a BK developing liquid to supply a black image are arranged along the direction to which the photosensitive body 1 is rotated. At the upper stream side of the rotational direction of the photosensitive body 1 of the developing apparatuses 7Y, 7M, 7C and 7BK, first to fourth charging apparatuses 3Y, 3M, 3C and 3BK are provided. Further, first to fourth exposing apparatuses 5Y, 5M, 5C and 5BK are provided between the charging apparatuses and the developing apparatuses that correspond to each color. For example, each of the exposing apparatuses 5Y, 5M, 5C and 5BK may be integrated in the case where it is a scanning exposing apparatus to scan, for example, the laser beam in an axial direction of the photosensitive body 1 provided that the final output laser beam can expose the image information of four color portions between the charging apparatuses 3Y, 3M, 3C and 3BK and the developing apparatuses 7Y, 7M, 7C and 7BK. When it is integrated, no limitation is imposed on its shape and the position thereof.

Each of the developing devices 7Y, 7M, 7C and 7BK has developing rollers 71Y, 71M, 71C and 71BK opposed to the outer peripheral surface of the photosensitive body 1 at intervals of 50to 200 $\mu$m, for example, at intervals of 150 $\mu$m (sometimes different for each color according to the characteristics of the toner) and squeeze rollers 73Y, 73M, 73C and 73BK which are provided at down stream side in the direction in which the photosensitive body 1 is rotated in the vicinity of each developing roller. Each of the squeeze rollers 73Y, 73M, 73C and 73BK are provided with a scraping blade (not shown) to separate the developing liquid existing around respective rollers 73Y, 73M, 73C and 73BK toward the corresponding housings 72Y, 72M, 72C and 72BK.

Each of the developing apparatuses 7Y, 7M, 7C and 7BK houses the developing liquid of four colors of Y, M, C and BK using Yellow series (KET Yellow 402; made by DAIN- IPPON INK AND CHEMICALS, INCORPORATED), Magenta series (KET Red 301; made by DAINIPPON INK AND CHEMICALS, INCORPORATED), Cyan series (Cyanian blue KRO made by Sanyo Color Works, Ltd) and Black (#750B; made by MITSUBISHI CVHEMICAL CORPORATION) as pigments, wherein a ratio of weight portion of the resin and the pigment is taken as 4:1 for the solvent to which the amount of non-volatile matter of the liquid developer is added so as to be one weight portion for the whole.

Four developing areas in which the respective developing apparatuses 7Y, 7M, 7C and 7BK and the photosensitive body 1 are opposed are applied with a predetermined developing bias which is substantially equal or according to the characteristic of the toner of each color in order to allow each color inside the developing liquid to effectively make an electrophoresis toward the photosensitive body 1. The toner (developing liquid) supplied on the latent images of each color on the photosensitive body 1 by using the respective developing apparatuses 7Y, 7M, 7C and 7BK is conveyed by electrostatic force between itself and the photosensitive body 1 in a state of adhering on the photosensitive body 1 accompanied with the rotation of the photosensitive body 1 and, in the vicinity of the black developing apparatus 7BK of the final stage and in a drying area opposed to the blower 9 provided at the down stream side of the rotational direction of the photosensitive body 1, the solvent (remaining on the photosensitive body 1 and inside the toner layer)is substantially eliminated. Further, accompanied with the rotation of the photosensitive body 1, the toner from which the solvent is eliminated is moved to an output transferring pressing (back up) roller 15 located at the upper stream in the direction in which the photosensitive body 1 is rotated in contrast to the top charging apparatus 3Y.

Meanwhile, in the color image forming apparatus shown in FIG. 6, though the image forming apparatus of an transferring system in which an intermediate transferring member is not provided between the back up roller 15 and the photosensitive body 1 is shown, it is also possible to use the intermediate transferring member as described earlier by using FIG. 5.

Each of the developing apparatuses 7Y, 7M, 7C and 7BK is integrally provided with toner circulation mechanisms 80Y, 80M, 80C and 80BK which were described by using FIG. 2 or FIG. 5. In this case, the mobility and the initial value of conductivity a of the toner contained in the toner liquid of each color which is circulated by each of the toner circulation mechanisms 80Y, 80M, 80C and 80BK are, for example, with regard to the Magenta toner, $\mu=1.5\times10^{-9}$ [$m^2$/Vs], $\sigma=7.6\times10^{-11}$ [S/cm] and, with regard to the Yellow toner, $\mu=4.1\times10^{-9}$ [$m^2$/Vs], $\sigma=7.9\times10^{-11}$ [S/cm].

Further, when the conductivity adjustment roller 75 shown in FIG. 2 is used as a conductivity adjustment mechanism, the interval d between the conductivity adjustment roller 75 incorporated in the Magenta developing apparatus 7M and the developing roller 71 is 200 $\mu$m, and the conductivity adjustment voltage applied between both rollers 71, 75 is preferably superposed with the AC voltage of 400V having a frequency of 20 Hz and a Vpp of 400V and the direct current component such as being 300V higher than the conductive adjustment roller 75 side for the developing roller 71. In the same manner, the interval d between the conductivity adjustment roller 75 incorporated in the Yellow developing apparatus 7Y and the developing roller 71 is 200 $\mu$m, and the conductivity adjustment voltage applied between both rollers 71, 75 is preferably superposed with the AC voltage of 400V having a frequency of 30 Hz and a Vpp of 400V and the direct current component such as being 300V higher than the conductive adjustment roller 75 side for the developing roller 71. The distance d between the conductivity adjustment roller 75 which is incorporated in the black developing apparatus 7BK and the developing roller 71 is 200 $\mu$m, and the conductivity adjustment voltage applied between both rollers 71, 75 is superposed with the AC voltage preferably having a frequency of 30 Hz and a Vpp of 400V and the direct current voltage such as being 300V higher than the conductivity adjustment roller 75 side for the developing roller 71.

On the other hand, when the conductivity control unit 78, to which two electrode plates are opposed as shown in FIG. 5, is used as the conductivity adjustment mechanism, the distance d between electrodes of the conductivity control unit 78 incorporated in the Magenta developing apparatus 7M is 200 $\mu$m, and the conductivity adjustment voltage applied between both electrodes is an AC voltage preferably having a frequency of 20 Hz and a Vpp of 400V. Similarly, the distance d between electrode plates of the conductivity adjustment unit 78 which is incorporated in the Yellow developing apparatus 7Y is an AC voltage preferably having a frequency of 30H and a Vpp of 400. The distance d between electrode plates of the conductivity control unit 78 which is incorporated in the Cyan developing apparatus 7C is 200 $\mu$m, and the conductivity adjustment voltage applied between both electrode plates is an AC voltage preferably having a frequency of 20 Hz and a Vpp of 400V.

As described above, that is, in the developing apparatus using the toner liquid where the toner is dispersed in the solvent, by allowing the conductivity of the toner liquid, which executes the conductivity adjustment mode each time the condensed toner is replenished, to bring near to the initial value (to lower to less than the initial value), the conductivity of the toner liquid can be prevented from undesirably increasing and lowing the minuteness of the image.

That is, two electrode plates that are independently arranged apart from the developing roller and the conductivity adjustment roller or from the developing roller are arranged at a predetermined interval and, in a state of the toner liquid being intervened between both rollers or two electrodes, at least a predetermined potential difference is provided between both rollers or electrodes so that the counter ion contained in the toner liquid and the charge of the excessive-ion having the same polarity as the toner are vanishingly recovered, thereby making it possible to prevent the conductivity of the toner liquid from undesirably increasing.

In this way, the amount of excessive-ion can be controlled to less than the regulated amount and the image defect such as the vanishing of the electrostatic latent image or the developed toner flowing into the non-image portion before it is solidified can be prevented.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a charging apparatus which applies a predetermined potential on a photosensitive body;

an exposing apparatus which forms an electrostatic latent image on the photosensitive body;

a developing apparatus which includes a developing roller opposed to the photosensitive body at a predetermined interval, supplies a toner liquid to the electrostatic latent image formed on the photosensitive body while maintaining the toner liquid between itself and the photosensitive body, and forms a toner image by selectively adhering the toner on said electrostatic latent image;

a toner liquid circulation mechanism which circulates the toner liquid maintained between itself and the photosensitive body by said developing roller of said developing apparatus while maintaining a toner density at a predetermined density;

a developing bias power supply capable of applying a predetermined bias voltage to said developing apparatus;

a conductivity detection mechanism which detects a conductivity inside the toner liquid circulated between said developing apparatus and said toner liquid circulation mechanism; and a conductivity control apparatus which reduces the conductivity of the toner liquid circulated between said developing apparatus and said toner liquid circulation mechanism to a predetermined level or less by vanishing a surplus counter ion inside the toner liquid and a charge of an excessive-ion having the same polarity as the toner.

2. The image forming apparatus according to claim 1, further comprising:

a conductivity adjustment power supply capable of applying a predetermined voltage to said conductivity control apparatus.

3. The image forming apparatus according to claim 2, wherein said conductivity control apparatus includes a conductive material opposed to said developing roller of said developing apparatus at a predetermined interval and, by being applied with a predetermined voltage between itself and said developing roller of said developing apparatus by said conductivity adjustment power supply, reduces the conductivity of the toner liquid circulated between itself and said toner circulation mechanism to a predetermined level or less.

4. The image forming apparatus according to claim 3, wherein said conductivity adjustment power supply can supply between said developing roller and said conductive material a voltage which can be obtained by:

$$\lambda > \mu(Vpp/2)/d^2,$$

where a mobility of the toner contained in the toner liquid is $\mu[m^2/Vs]$, a distance between said conductive material and said developing roller of said developing apparatus is d [m], a frequency is $\lambda$ [Hz], and a peak to peak voltage of an AC voltage is Vpp [V].

5. The image forming apparatus according to claim 2, wherein said conductivity control apparatus includes two electrode plates opposed to each other, which are independently provided apart from said developing roller of said developing apparatus and, by being applied with a predetermined voltage between electrode plates by said conductivity adjustment power supply, reduces the conductivity of the toner liquid circulated between itself and said toner liquid circulation mechanism to a predetermined level or less.

6. The image forming apparatus according to claim 3, wherein said conductivity adjustment power supply can supply to said conductive material a direct current voltage capable of supplying a predetermined potential difference to said developing roller, in addition to a voltage which can be obtained by:

$$\lambda > \mu(Vpp/2)/d^2,$$

where a mobility of the toner contained in the toner liquid is $\mu[m^2/Vs]$, a distance between said conductive material and said developing roller of said developing apparatus is d [m], a frequency is $\lambda$ [Hz], and a peak to peak voltage of an AC voltage is Vpp [V].

7. The image forming apparatus according to claim 4, wherein said conductivity adjustment power supply can supply between said two electrodes a voltage which can be obtained by:

$$\lambda > \mu(Vpp/2)/d^2,$$

where a mobility of the toner contained in the toner liquid is $\mu[m^2/Vs]$, a distance between said two electrodes is d [m], a frequency is $\lambda$ [Hz], and a peak to peak voltage of an AC voltage is Vpp [V].

8. A method for developing a latent image on a photosensitive body by using a toner liquid in which toner is dispersed in a non-polarity solvent and forming a toner image on the photosensitive body comprising:

providing a predetermined potential to the photosensitive body;

forming an electrostatic latent image on the photosensitive body by exposing an image on the photosensitive body by an exposing apparatus;

selectively supplying and developing the toner from the toner liquid on the electrostatic latent image; and replenishing an amount of toner consumed while developing the toner from the toner liquid on the electrostatic latent image by a condensed toner liquid in which a solid content density is higher than a density of the toner from the toner liquid, and reducing a conductivity of the toner liquid increased while replenishing the toner by a conductivity control apparatus so that an image forming condition is maintained constant, wherein the conductivity of the toner liquid is controlled in accordance with the following steps of:

measuring the density of the toner from the toner liquid with a toner density sensor;

comparing a reference value of a predetermined toner density with the density of the toner from the toner liquid as measured by the toner density sensor;

replenishing a predetermined amount of condensed toner liquid if the density of the toner from the toner liquid as measured by the toner density sensor is smaller than the reference value;

measuring a conductivity of the toner liquid as replenished with the condensed toner liquid by a conductivity measuring apparatus;

comparing the conductivity of the toner liquid as measured by the conductivity measuring apparatus with a predetermined conductivity of the toner liquid decided in advance;

applying a predetermined conductivity adjustment voltage to a conductivity adjustment roller if the conductivity of the toner liquid as measured by the conductivity measuring apparatus is larger than the predetermined conductivity;

continuing the application of the predetermined conductivity adjustment voltage to the conductivity adjustment roller and the measurement of the conductivity of the toner liquid as replenished with the condensed toner liquid until the conductivity of the toner liquid as measured by the conductivity measuring apparatus becomes equal to or smaller than the predetermined conductivity; and returning the conductivity adjustment roller to a float state if an energization to the conductivity adjustment roller is continued and the conductivity of the toner liquid as measured by the conductivity measuring apparatus becomes equal to or smaller than the predetermined conductivity.

9. The method according to claim 8, wherein, when the conductivity of the toner liquid is increased to a predetermined level as a result of the replenishment of the condensed toner liquid to the toner liquid where the toner was consumed, according to the measured result of a conductivity of the toner liquid by the conductivity measuring apparatus, the replenishment of the condensed toner liquid is terminated.

10. A method for developing a latent image on a photosensitive body by using a toner liquid in which toner is dispersed in a non-polarity solvent and forming a toner image on the photosensitive body comprising:

providing a predetermined potential to the photosensitive body;

forming an electrostatic latent image on the photosensitive body by exposing an image on the photosensitive body by an exposing apparatus;

selectively supplying and developing the toner from the toner liquid on the electrostatic latent image; and replenishing an amount of toner consumed while developing the toner from the toner liquid on the electrostatic latent image by a condensed toner liquid in which a solid content density is higher than a density of the toner from the toner liquid, and reducing a conductivity of the toner liquid increased while replenishing the toner by a conductivity control apparatus so that an image forming condition is maintained constant wherein the conductivity control apparatus includes a conductive material opposed to a developing roller of a developing apparatus at a predetermined interval and, by being applied with a predetermined voltage between itself and the developing roller, reduces the conductivity of the toner liquid, in which the condensed toner is replenished, to a predetermined level or less.

11. The image forming method according to claim 10, wherein the condensed toner liquid includes a charge control agent of the same ratio as that of the solid content.

12. The image forming method according to claim 10, wherein the conductivity control apparatus is applied with a voltage which can be obtained by:

$$\lambda > \mu(Vpp/2)/d^2,$$

where a mobility of the toner contained in the toner liquid is $\mu[m^2/Vs]$, a distance between itself and the developing roller is d [m], a frequency is $\lambda$ [Hz], and a peak to peak voltage of an AC voltage is Vpp [V].

13. The image forming method according to claim 10, wherein the conductivity control apparatus is supplied with the direct current voltage capable of supplying a predetermined potential difference to the developing roller, in addition to a voltage which can be obtained by:

$$\lambda > \mu(Vpp/2)/d^2,$$

where a mobility of the toner contained in the toner liquid is $\mu[m^2/Vs]$, a distance between itself and the developing roller is d [m], a frequency is $\lambda$ [Hz], and a peak to peak voltage of an AC voltage is Vpp [V].

14. The image forming method according to claim 10, wherein the conductivity control apparatus includes two electrode plates opposed to each other, wherein a voltage between the electrode plates can be obtained by:

$$\lambda > \mu(Vpp/2)/d^2,$$

where a mobility of the toner contained in the toner liquid is $\mu[m^2/Vs]$, a distance between (own) electrodes is d [m], a frequency is $\lambda$ [Hz], and a peak to peak voltage of an AC voltage is Vpp [V].

* * * * *